US006116687A

United States Patent [19]

Vogtherr

[11] Patent Number: 6,116,687

[45] Date of Patent: Sep. 12, 2000

[54] FUNCTIONAL CHAIR

[76] Inventor: Burkhard Vogtherr, 4 Rue du Molkenrain, F-68100 Mulhouse, France

[21] Appl. No.: 09/249,827

[22] Filed: Feb. 12, 1999

[30] Foreign Application Priority Data

Feb. 12, 1998 [DE] Germany ..... 298 02 360 U

[51] Int. Cl.[7] ..... A47C 1/024

[52] U.S. Cl. ..... 297/300.1; 297/291; 297/301.1

[58] Field of Search ..... 297/313, 325, 297/326, 316, 291, 337, 354.1, 354.11, 300.1, 301.1

[56] References Cited

U.S. PATENT DOCUMENTS

| | | |
|---|---|---|
| 826,575 | 7/1906 | Hunter . |
| 1,437,848 | 12/1922 | Kisor . |
| 2,662,586 | 12/1953 | Cramer . |
| 2,796,920 | 6/1957 | Cowles . |
| 3,602,537 | 8/1971 | Kerstholt et al. . |
| 3,934,930 | 1/1976 | Sandham . |
| 4,789,203 | 12/1988 | Van Zee et al. . |
| 5,649,740 | 7/1997 | Hodgdon . |

FOREIGN PATENT DOCUMENTS

| | | | |
|---|---|---|---|
| 825147 | 12/1951 | Germany | 297/291 |
| 623225 | 5/1949 | United Kingdom | 297/291 |

*Primary Examiner*—Milton Nelson, Jr.

[57] ABSTRACT

A seat part (20) of a functional chair is connected to a head part (16) of the pedestal (10) via a joint (18) comprising elastomeric material (38) such that it can be tilted relative to the head part (16) against spring force. A backrest part (28) is similarly connected via a joint (26) to a backrest support (24) which allows the backrest part (28) to tilt relative to the backrest support (24) about a horizontal axis and about an axis which is parallel to the longitudinal direction of the backrest.

13 Claims, 7 Drawing Sheets

FUNCTIONAL CHAIR

DESCRIPTION

The invention relates to a functional chair according to the preamble of claim 1.

Functional chairs of this kind have a pedestal which usually bears a seat part via a vertically adjustable strut. A backrest part is fitted to the pedestal part or to the seat part via a backrest support such that it can swivel and can either be adjusted by the user against the force of a biasing spring or locked in its inclined position.

For some applications it would be advantageous if the seat part and/or the backrest part could in addition be adjusted according to the sedentary posture of the user at the time.

The invention provides a functional chair having the features presented in claim 1 in order to achieve this effect.

The backrest part and/or the seat part of the functional chair according to the invention may in addition turn about an axis which is parallel to the swivel axis of the backrest support (hence a horizontal transverse axis in practice). The user can therefore adopt sitting positions in which the seat surface optionally tilts downwards slightly, as well as positions in which the backrest part is adjusted so as tilt slightly further forwards or backwards.

Advantageous developments of the invention are presented in subclaims.

The development of the invention according to claim 2 is of advantage with regard to easily tilting the backrest part or seat part in both tilting directions.

The backrest part of a functional chair according to claim 3 can also turn about a vertical axis, thereby providing an additional possibility of adapting it to the sedentary posture of the user.

If the joints are formed according to claim 4, they can be produced at a very low cost. The joints also require little maintenance and produce little noise under stress.

The development of the invention according to claim 5 is of advantage with regard to transmitting forces through the joint without this damaging the material.

According to claim 6, the size of the plates to which the elastomeric material piece is fitted can for the same reasons be selected such that the joint associated with the seat part covers a substantial part of the seat surface.

The development of the invention according to claim 7 ensures on the one hand that the seat part can be tilted, yet on the other that the seat is not mounted so as to be unpleasantly "spongy".

The development of the invention according to claim 8 is of advantage with regard to swivelling the backrest part unobstructed.

The invention is illustrated in detail in the following on the basis of an embodiment and with reference to the drawings, in which.

Figure 1:
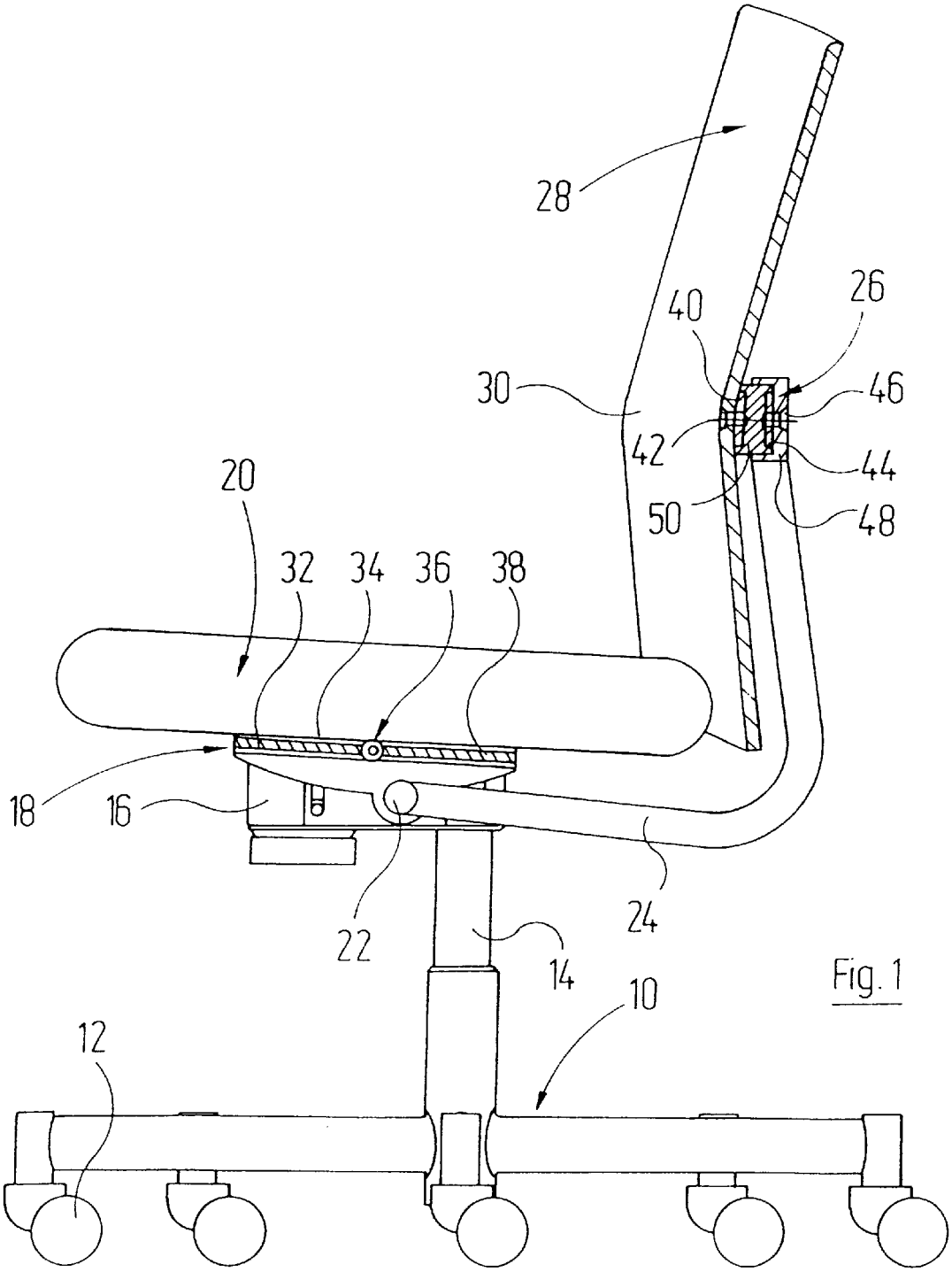
FIG. 1 is a side view of a functional chair wherein a backrest part and its mounting are cut in the longitudinal central plane.

The functional chair which is reproduced in the drawings has a five-arm pedestal 10 which runs on castors 12. The pedestal 10 comprises, in the conventional manner, a telescope 14 for vertical adjustment purposes. A head part 16 of the pedestal 10 is fitted to the telescope 14 and bears a seat part 20 via a joint which is designated as a whole by 18. A backrest support 24 is also mounted such that it can swivel in the head part 16 via a shaft 22. The backrest support 24 comprises two tubular parts which are angled symmetrically in relation to the longitudinal central plane of the backrest part 28 and each of which, below the seat part 20, firstly slopes downwards at an angle of approximately 10 ° with respect to the horizontal and then extends upwards, with the upper sections of the arms of the backrest support 24 forming an angle of approximately 15 ° with the vertical.

Figure 5:
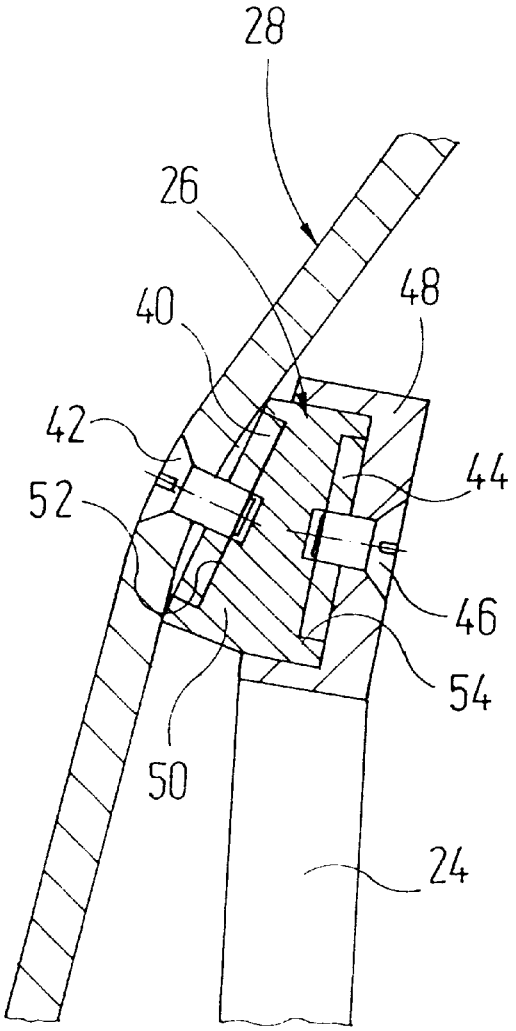
FIG. 5 is a view onto the functional chair according to FIG. 1 which additionally shows how the backrest part can be swivelled about a vertical axis.

A backrest part 28 is fitted to the upper end of the backrest support 24 via a joint which is designated as a whole by 26. Considered in longitudinal section, the backrest part 28 has a bending region 30 at the level of the joint 26. Otherwise, considered in a horizontal sectional view, the backrest part is in the form of a circular arc, as shown in FIG. 5. A lower section of the backrest part 28 surrounds the rear edge of the seat part 20 at a spacing.

The joint 18 comprises a lower end plate 32, which is connected to the head part 16, and an upper end plate 34, which is rigidly connected to the underside of the seat part 20. The two end plates 32, 34 are connected together via a hinge 36, and the interspace between the two end plates 32, 34 is filled by a material layer 38 which has the geometry of a plate and consists of elastomeric material which may typically have a Shore hardness of approximately 70 °. The thickness of the material layer 38 is in practice between 10 and 20 mm.

The joint 26 comprises a first end plate 40, which is rigidly connected to the backrest part 28 via a countersunk screw 42. A second end plate 44 of the joint 26 is connected to an upper joint holding section 48 of the backrest support 24 via a second countersunk screw 46.

A material layer 50 is vulcanized into the space between the two end plates 40, 46. This layer in turn consists of an elastomeric material with a Shore hardness of typically approximately 70°.

Figure 3:
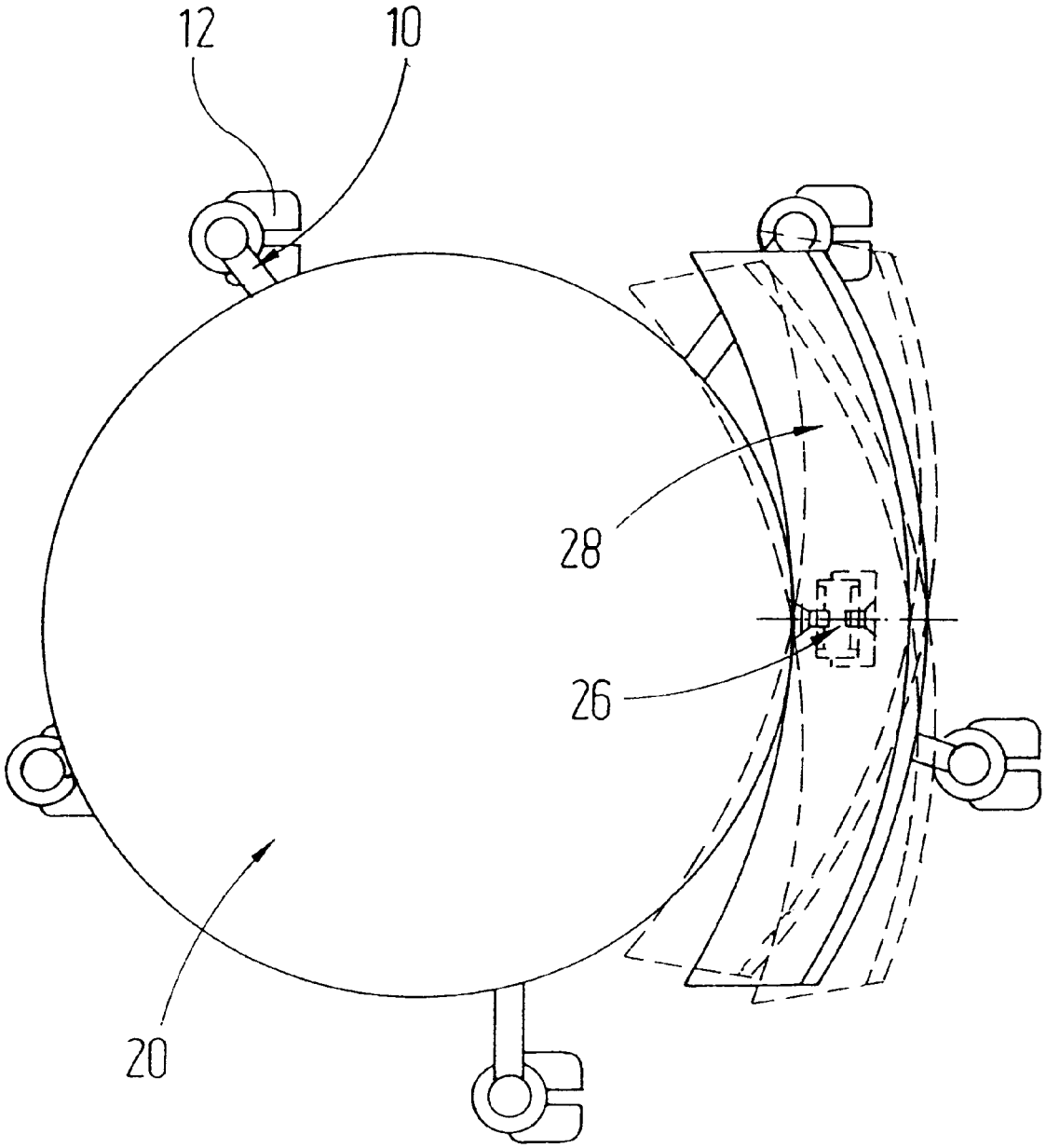
FIGS. 3 and 4 are enlarged views of a joint via which the backrest part is connected to a backrest support in the unloaded and loaded, tilted state, respectively.
Figure 4:
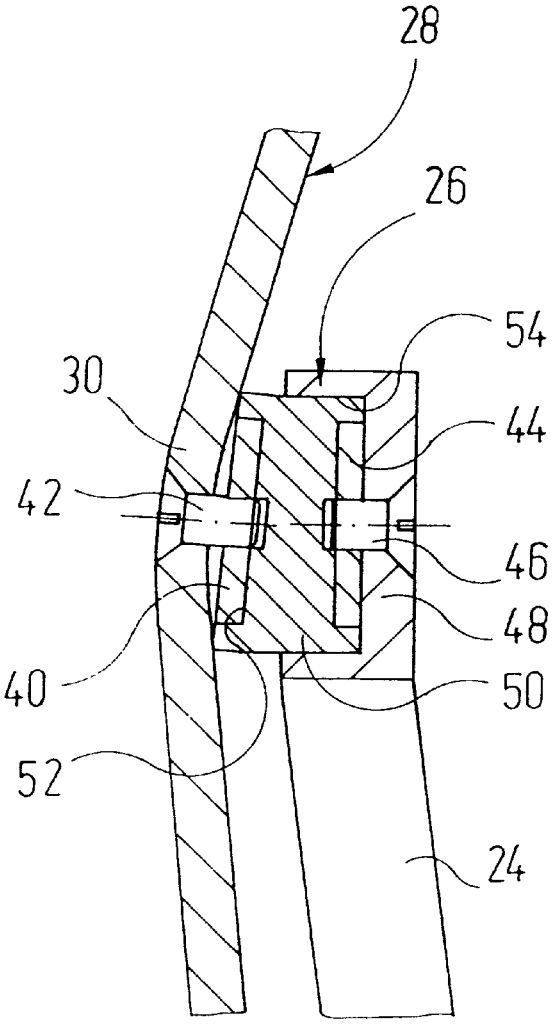

As can be seen from FIGS. 3 and 4, the end plates 40 and 46 are seated in shallow recesses 52 provided in the end faces of the material layer 50, which is cylindrical overall. The majority of the material layer 50 is held in a holding chamber 54 provided in the joint holding section 48.

The joint 18 is a uniaxial joint, the axis of which is predetermined by the hinge 36. This axis extends in a predetermined horizontal direction and would be parallel to the front edge of the seat if the seat part 20 were to have a rectangular peripheral contour and parallel to the backrest surface if the backrest part 28 were to have a plane geometry.

Figure 6:
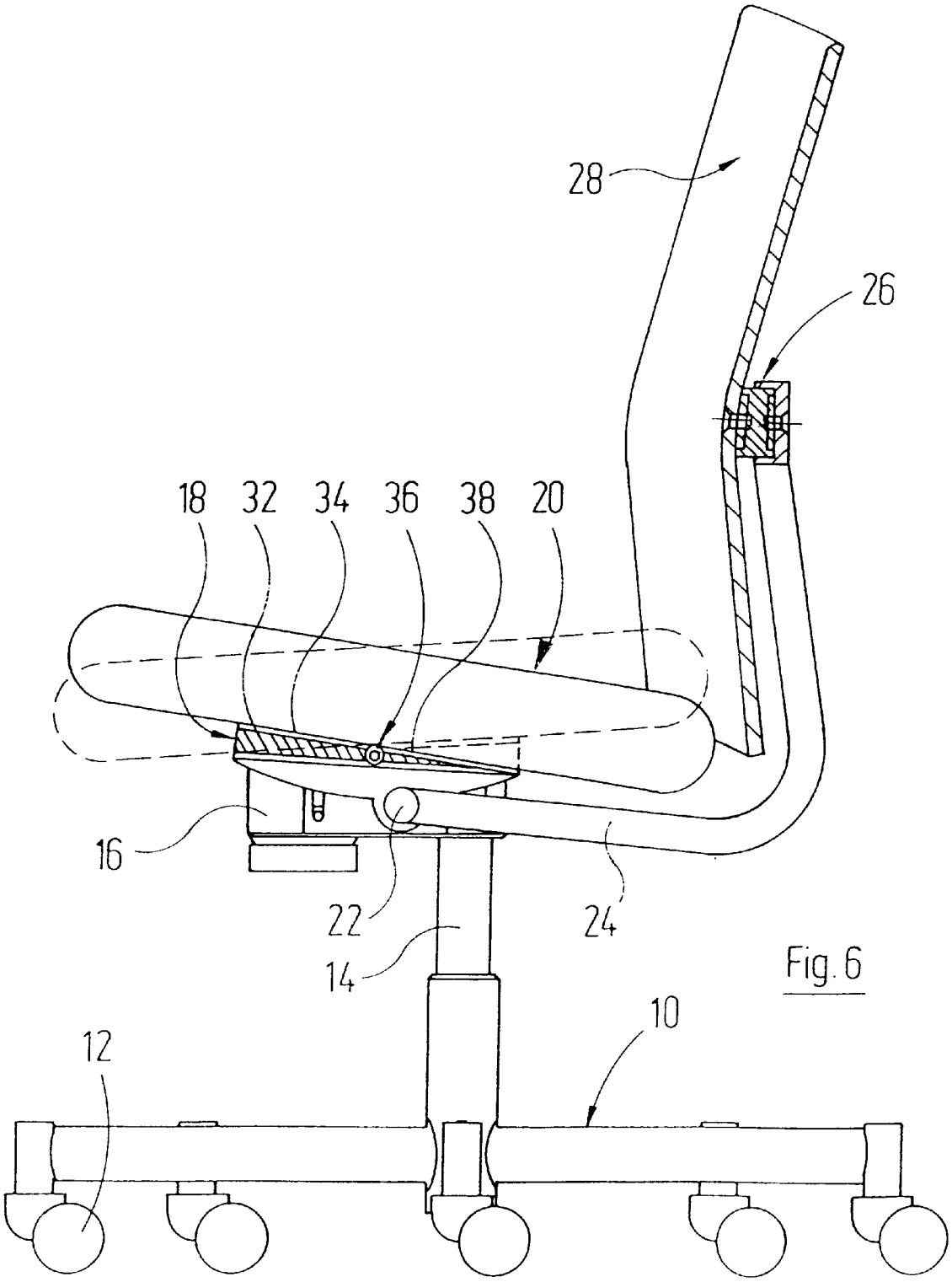
FIG. 6 is a view corresponding to FIG. 1, although additionally shows a seat part position tilted forwards and backwards, respectively.
Figure 7:
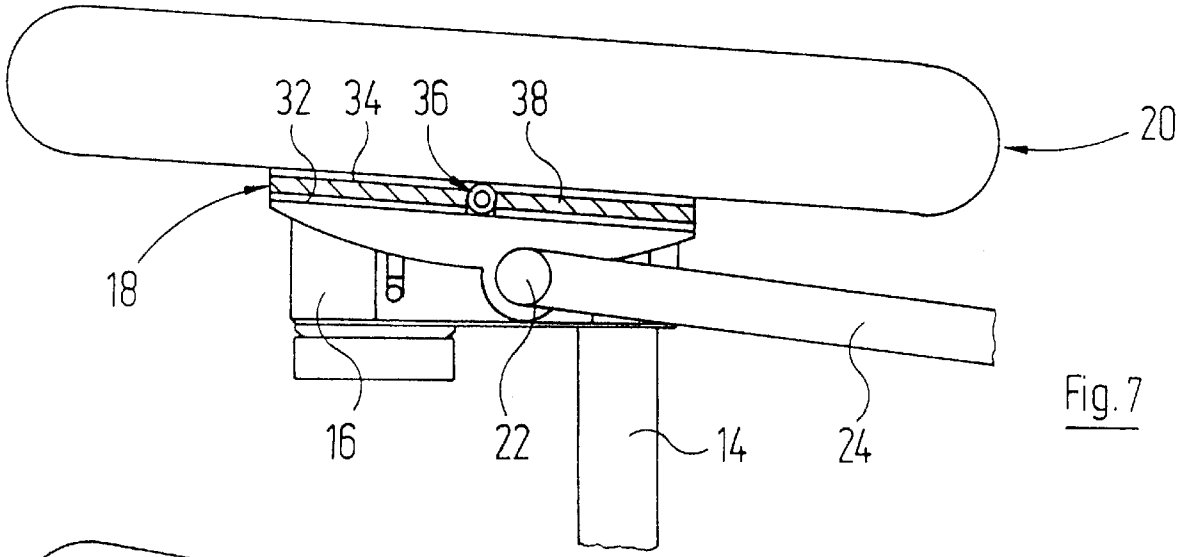
FIGS. 7 and 8 are enlarged views showing a joint via which the seat part is connected to the pedestal in the state of rest and in the loaded state when tilted forwards and backwards, respectively.
Figure 8:
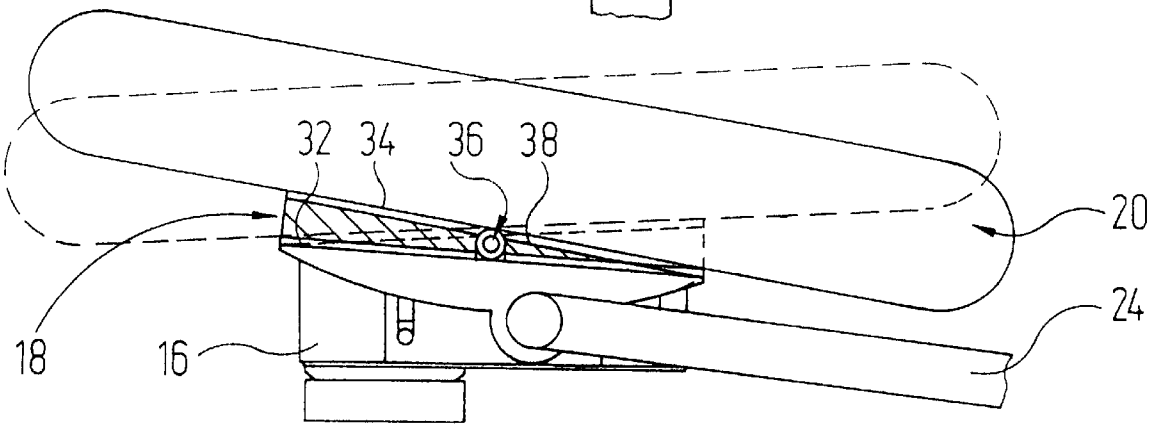

If the material piece 38 is elastically compressed, the seat part 20 can be tilted backwards or forwards through approximately 15 ° from the slightly backward sloping orientation adopted in the unloaded state, as shown quite clearly by FIGS. 6 to 8. The maximum tilting travel is limited by the material layer 38 being arrested at the rear or front edge of the end plates 32, 34.

Figure 2:
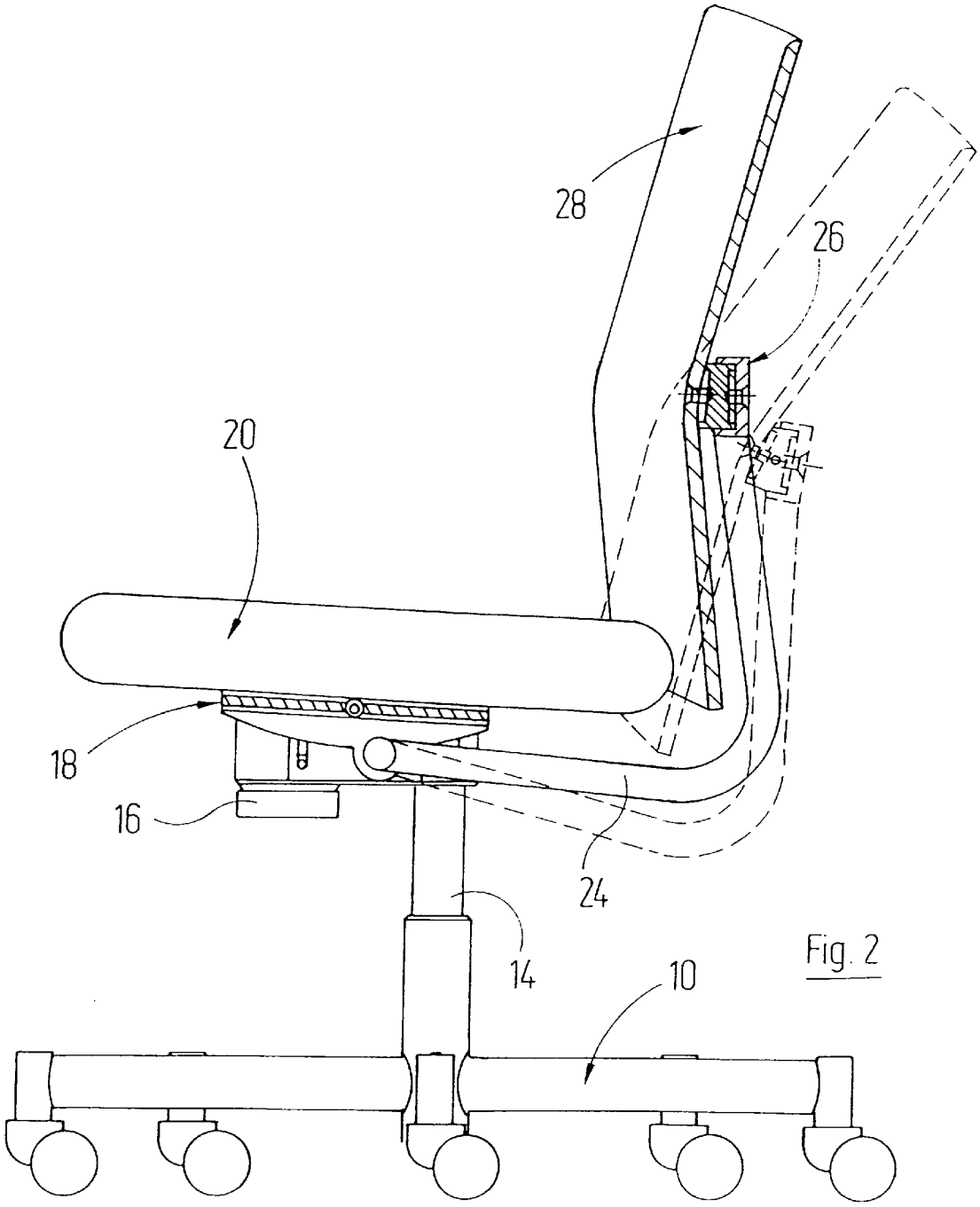
FIG. 2 is a view similar to FIG. 1 which additionally shows a position of the backrest part in which this is lowered and additionally tilted about its bearing point.

However the joint 26 is a biaxial joint. The end plate 40 can be tilted relative to the end plate 44 both about a horizontal axis and about an axis which is parallel to the longitudinal direction of the backrest part 28. Therefore, as shown in FIG. 2, by leaning quite far back the user can swivel the backrest part 28 relative to the backrest support 24 about a horizontal axis in addition to swivelling the backrest support 24 downwards against the force of a biasing spring acting on it. The backrest part 28 can in addition be turned about its longitudinal axis, as shown in FIG. 3.

The backrest part 28 can thus easily follow the movement of the back of a person sitting on the chair.

The deformation of the material piece 50 is limited at the joint 26 by the lower end of the backrest part 28 coming to bear against the backrest support 24 or against the rear of the seat part 20.

Figure 9:
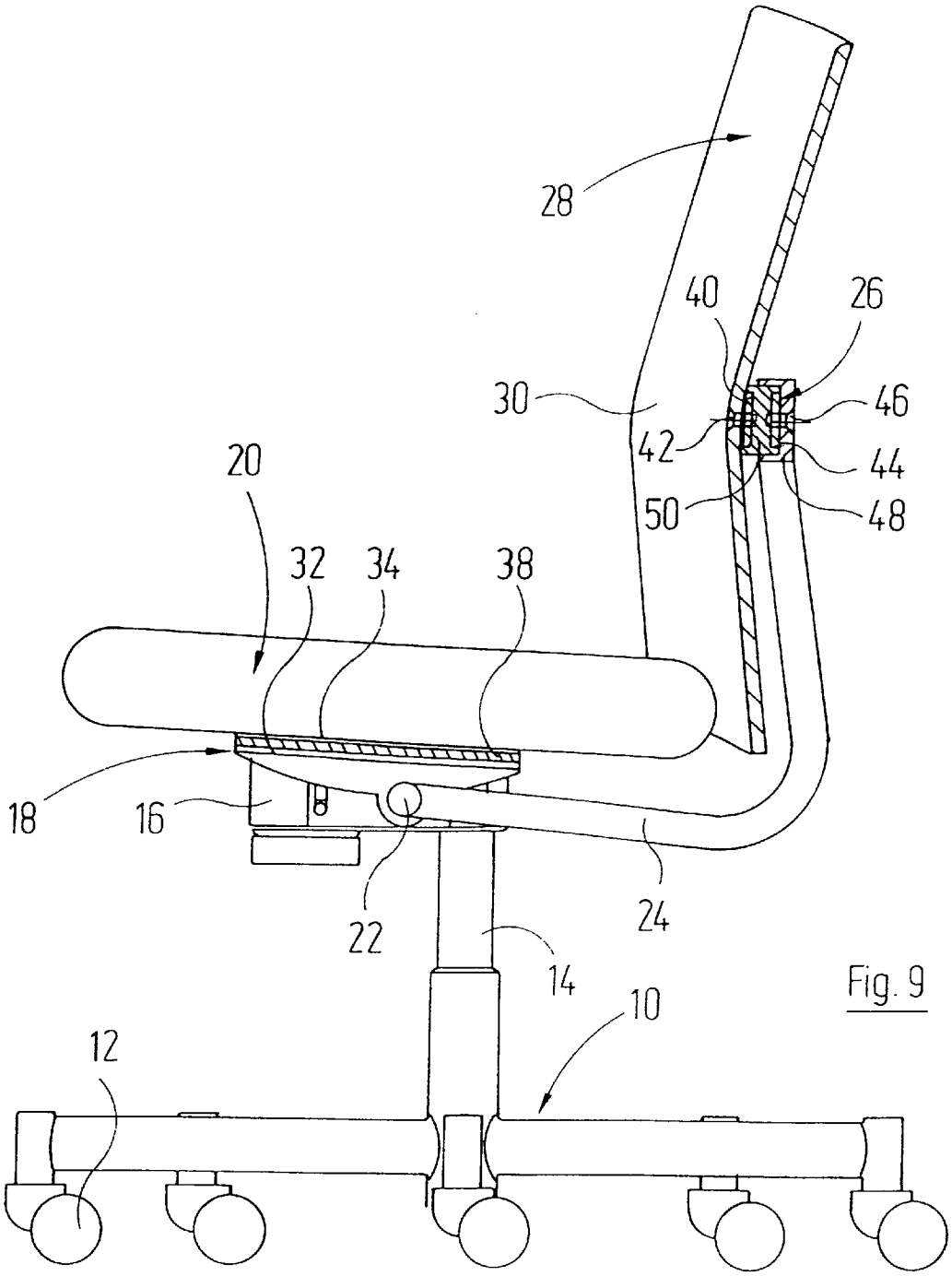
FIG. 9 is a view similar to FIG. 1, although with a modified seat part mounting.

The hinge 36 may be omitted from a modified embodiment reproduced in FIG. 9, so that the joint 18 is only formed by the material layer 38 and, just like the joint 26, can be moved in two independent directions. The seat surface can thus be inclined forwards and backwards and also in the lateral direction at the same time.

What is claimed is:

1. Functional chair with a pedestal (10), with a seat part (20) borne by the pedestal (10) and with a backrest part (28), which is disposed on a swivelling backrest support (24), characterised in that the seat part (20) is connected to the pedestral part (10) via a joint (18) having a joint axis (36) parallel to the swivel axis (22) of the backrest support (24), the backrest part (28) is connected to the backrest support (24) via a joint axis parallel to the swivel axis (22) of the backrest support (24), and a joint (26) bearing the backrest part (28) has a second rotational joint axis parallel to the longitudinal axis of the backrest part (28) so that the backrest part (28) can be swiveled about the longitudinal axis.

2. Functional chair according to claim 1, characterised in that the joints (18, 26) are disposed substantially at the geometric centre of the seat part (20) and backrest part (28), respectively.

3. Functional chair according to claim 1, characterised in that the backrest part (28) has a bend (30) in the region of the joint (26) bearing the backrest part (28).

4. Functional chair according to claim 1, characterised in that at least one of the joints (18, 26) comprises an elastomeric material piece (38; 50) which is disposed between two rigid end plates (32, 34, 40, 44), and vulcanized onto the end plates.

5. Functional chair according to claim 4, characterised in that the end plates (32, 34; 40, 44) are plate-shaped.

6. Functional chair according to claim 5, characterised in that the elastomeric material piece (38) of the joint (18) bearing the seat part (20) extends over 30 to 60%, of the dimensions of the seat part (20).

7. Functional chair according to claim 6, characterised in that the elastomeric material piece (38) extends over approximately 40% of the dimensions of the seat part (20).

8. Functional chair according to claim 4, characterised in that the elastomeric material piece (38) for the joint (18) bearing the seat part (20) has a thickness of between 1 and 4 cm.

9. Functional chair according to claim 8, characterised in that the elastomeric material piece has a Shore hardness of approximately 70°.

10. Functional chair according to claim 8, characterised in that the elastomeric material piece has a thickness of approximately 2 cm.

11. Functional chair with a pedestal (10), with a seat part (20) borne by the pedestal (10) and a backrest part (28) that is disposed on a swivelling backrest support (24), characterised in that the seat part (20) is connected to the pedestal part (10) via a joint (18) having a joint axis (36) parallel to the swivel axis (22) of the backrest support (24), the backrest part (28) is connected to the backrest support (24) via a joint (26) having at least one joint axis parallel to the swivel axis (22) of the backrest support (24), and a second rotational joint axis parallel to the longitudinal axis of the backrest part (28) so that the backrest part (28) can be swiveled about the longitudinal axis and the backrest part (28) has a bend (30) in the region of the joint (26) bearing the backrest part (28).

12. Functional chair with a pedestal (10), with a seat part (20) borne by the pedestal (10) and with a backrest part (28), which is disposed on a swivelling backrest support (24), characterised in that the seat part (20) is connected to the pedestal part (10) via a joint (18) having a joint axis (36) parallel to the swivel axis (22) of the backrest support (24), the backrest part (28) is connected to the backrest support (24) via a joint (26) having at least one joint axis parallel to the swivel axis (22) of the backrest support (24), one of the joints (18, 26) comprises an elastomeric material piece (38; 50) which is disposed between two rigid end plates (32, 34; 49, 44), vulcanized onto the end plates, and the elastomeric material piece (38) of the joint (18) bearing the seat part (20) extends over 30 to 60% of the dimensions of the seat part (20).

13. Functional chair with a pedestal (10), with a seat part (20) borne by a pedestal (10) and a backrest part (28) that is disposed on a swivelling backrest support (24), characterised in that the seat part (20) is connected to the pedestal part (10) via a joint (18) having a joint axis (36) parallel to the swivel axis (22) of the backrest support (24), the backrest part (28) is connected to the backrest support (24) via a joint (26) having at least one joint axis parallel to the swivel axis (22) of the backrest support (24), at least one of the joints (18, 26) comprises an elastomeric material piece (38; 50) that is disposed between two rigid end plates (32, 34; 49, 44), vulcanized onto the end plate and the elastomeric material piece (38) for the joint (18) bearing the seat part (20) has a thickness of between 1 and 4 cm.

* * * * *